US010647018B2

(12) United States Patent
Bullion

(10) Patent No.: US 10,647,018 B2
(45) Date of Patent: May 12, 2020

(54) DOUBLE ARBOR VERTICAL SHAPE SAW

(71) Applicant: USNR, LLC, Woodland, WA (US)

(72) Inventor: Conrad Bullion, LaCenter, WA (US)

(73) Assignee: USNR, LLC, Woodland, WA (US)

( * ) Notice: Subject to any disclaimer, the term of this patent is extended or adjusted under 35 U.S.C. 154(b) by 210 days.

(21) Appl. No.: 15/671,130

(22) Filed: Aug. 7, 2017

(65) Prior Publication Data

US 2018/0056539 A1 Mar. 1, 2018

Related U.S. Application Data

(62) Division of application No. 13/804,534, filed on Mar. 14, 2013, now Pat. No. 9,724,839.

(60) Provisional application No. 61/768,302, filed on Feb. 22, 2013.

(51) Int. Cl.

| | |
|---|---|
| ***B27B 7/04*** | (2006.01) |
| ***B27B 1/00*** | (2006.01) |
| ***B27B 3/28*** | (2006.01) |
| ***B27B 7/02*** | (2006.01) |
| ***B27G 13/02*** | (2006.01) |

(52) U.S. Cl.

CPC ..... *B27B 7/04* (2013.01); *B27B 1/007* (2013.01); *B27B 3/28* (2013.01); *B27B 7/02* (2013.01); *B27G 13/02* (2013.01); *Y10T 83/741* (2015.04); *Y10T 83/778* (2015.04)

(58) Field of Classification Search

CPC .... B27B 7/00; B27B 7/02; B27B 7/04; B27B 5/26; B27B 1/00; B27B 1/007; B27G 13/00; B27G 13/005; B27G 13/02; B27G 13/04; B27G 13/06; B27G 13/08; B27G 13/10

See application file for complete search history.

(56) References Cited

U.S. PATENT DOCUMENTS

| | | | | |
|---|---|---|---|---|
| 6,062,281 A * | 5/2000 | Dockter | ..... | B27B 1/007 144/3.1 |
| 6,705,363 B2 * | 3/2004 | McGehee | ..... | B27B 1/007 144/245.2 |
| 2004/0261590 A1 * | 12/2004 | Conry | ..... | B27B 7/04 83/51 |

* cited by examiner

*Primary Examiner* — Matthew Katcoff
(74) *Attorney, Agent, or Firm* — Schwabe Williamson & Wyatt, P.C.

(57) ABSTRACT

Embodiments relate to systems, methods, and apparatuses for shape sawing wood. Specifically, embodiments include an infeed with laterally displaceable positioning rolls and a longitudinal axis between the positioning rolls. The embodiments further include a saw box with a frame and a plurality of saws coupled with a plurality of vertical arbors within the frame. In certain embodiments, the frame is operable to move laterally or rotationally with respect to a horizontal axis of rotation.

18 Claims, 8 Drawing Sheets

DOUBLE ARBOR VERTICAL SHAPE SAW

CROSS-REFERENCE TO RELATED APPLICATIONS

Embodiments of the present invention relate generally to the technical field of shape sawing logs and, in particular, to systems with a laterally and rotationally moveable saw box containing dual vertical arbor saws.

FIELD

Embodiments of the present invention relate generally to the technical field of shape sawing logs and, in particular, to systems with a laterally and rotationally moveable saw box containing dual vertical arbor saws.

BACKGROUND

When a log, cant, or similar lumber piece (collectively referred to as a log) is sawed, the logs may be of varying shapes and sizes. For example, a log may be curved. Alternatively, different logs may have different sizes. However, it is desirable to maximize the number of usable pieces of lumber that can be produced by sawing the log. To do so, it may be desirable to remove lumber slabs or boards from the log by sawing along the curvature of the log to provide boards having parallel and curved faces that follow the log curve. Doing so maximizes the boards that can be cut from the log. These boards may be subsequently straightened. This process is referred to as shape sawing.

Existing devices for shape sawing may have problems in certain situations. For example, if a log is too large, then a single arbor saw blade may not be sufficient to cut the log and a dual vertical arbor saw may be required. However, a smaller log may then be introduced to the shape sawing system and the dual vertical arbor saw may be wasteful or otherwise undesirable. Alternatively, the logs may not be oriented such that they can be appropriately sawed.

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example and not by way of limitation in the figures of the accompanying drawings.

DETAILED DESCRIPTION

In the following detailed description, reference is made to the accompanying drawings which form a part hereof wherein like numerals designate like parts throughout, and in which is shown by way of illustration embodiments that may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The description may use the phrases "in an embodiment," or "in embodiments," which may each refer to one or more of the same or different embodiments. Furthermore, the terms "comprising," "including," "having," and the like, as used with respect to embodiments of the present disclosure, are synonymous.

Embodiments described herein are directed to a dual vertical arbor saw and infeed. The dual vertical arbor saw may have a saw box that is pivotable around, and laterally repositionable along, a generally horizontal axis of rotation. Thus, the saw box (and saws within) can be moved laterally while pivoting to follow the sweep of a log or cant feeding into the saws. The infeed may include one or more chipper units with positioning rolls. The positioning rolls may be coupled to a pair of levers that are joined at a common pivot point. The levers can be actuated to move the positioning rolls synchronously toward and away from a longitudinal center for accurate positioning of logs or cants feeding in to the saw.

Figure 1:
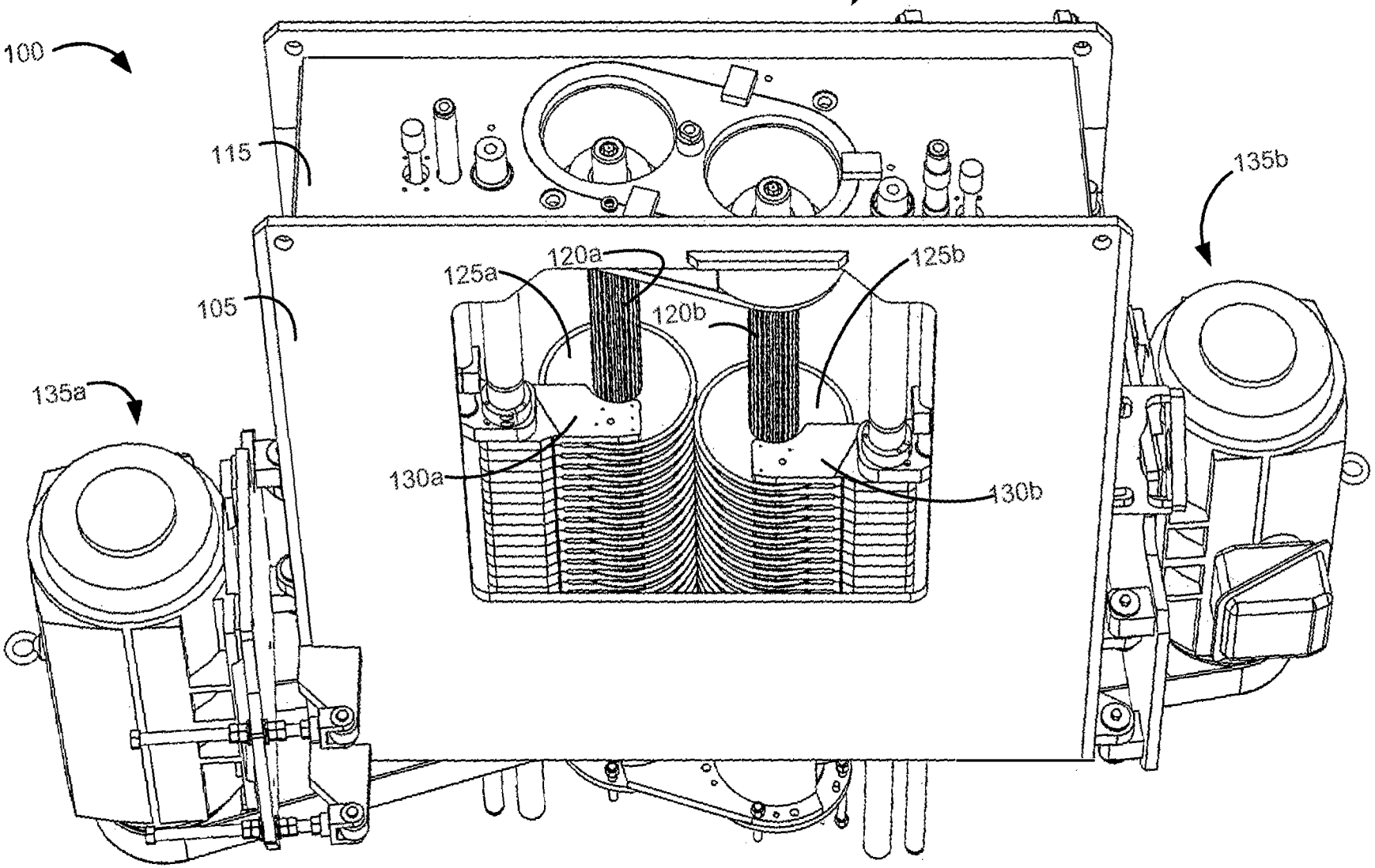
FIG. 1 depicts a perspective view of a simplified saw box, according to embodiments.

FIG. 1 depicts a simplified perspective view of a saw box 100 according to embodiments of the present disclosure. The saw box 100 may comprise a front side 105, a back side 110, and a top side 115. A longitudinal axis may be defined as an axis from the front side 105 of the saw box 100 to the back side 110 of the saw box. A horizontal axis may be defined as an axis perpendicular to the longitudinal axis and generally parallel to the top side 115 of the saw box 100. The saw box 100 may include two generally vertically oriented arbors 120*a*, 120*b*. A gang saw 125*a*, 125*b* may be mounted on each of the two vertical arbors 120*a*, 120*b*. The saw box 100 may further include a guide 130*a*, 130*b* for each of the two vertical arbors 120*a*, 120*b*. Finally, a drive 135*a*, 135*b* may be coupled with, and configured to rotate, each of the two vertical arbors 120*a*, 120*b*, thereby rotating the two gang saws 125*a*, 125*b*.

The arbors 120*a*, 120*b* and the gang saws 125*a*, 125*b*, may be both horizontally and longitudinally offset from one another as shown in FIG. 1. For example, as shown in FIG. 1 arbor 120*b* may be closer to the front side 105 of the saw box 100 than arbor 120*a*, while arbor 120*a* may be closer to the back side 110 of the saw box 100 than arbor 120*b*. In this arrangement, the gang saws 125*a*, 125*b* may be positioned such that the blades of the gang saws 125*a*, 125*b* slightly overlap along the longitudinal axis of the saw box 100, but are offset along the longitudinal axis so that they do not collide with one another. A log travelling longitudinally through the saw box 100 may therefore be thoroughly sawed by gang saws 125*a*, 125*b*.

It will be understood that in other embodiments the arbors may not be offset from one another in one or both of the horizontal and longitudinal directions. In other embodiments, arbor 120*a* may be closer to the front side 105 of the saw box 100 than arbor 120*b*. Additionally, arbors 120*a*, 120*b* may each be rotated by a plurality of drives, or a single drive. In some embodiments, the arbors may spin in directions opposite to one another, and in other embodiments the arbors may spin in directions identical to one another. In certain embodiments, the gang saws 125*a*, 125*b* may have the same or different diameters. In some embodiments, the diameter of the gang saws 125*a*, 125*b* may be large enough to cut logs with a diameter between 6" and 8". In other embodiments the gang saws 125*a*, 125*b* may have larger or smaller diameters.

In some embodiments, the top side 115 of the saw box 100 may be at least partially removable such that the interior of the saw box 100 is accessible without having to remove the saw box partially or completely from a sawing system For example, the top side 115 of the saw box 100 may have hinges, clasps, or some other form of fastening that allow the top side 115 to be removed from the saw box 100. A removable top side 115 may be desirable because it may make it easier for an individual to access or repair the interior of the saw box 100, or elements such as the arbors 120*a*, 120*b*, the gang saws 125*a*, 125*b*, or the guides 130, 130*b*.

Figure 2:
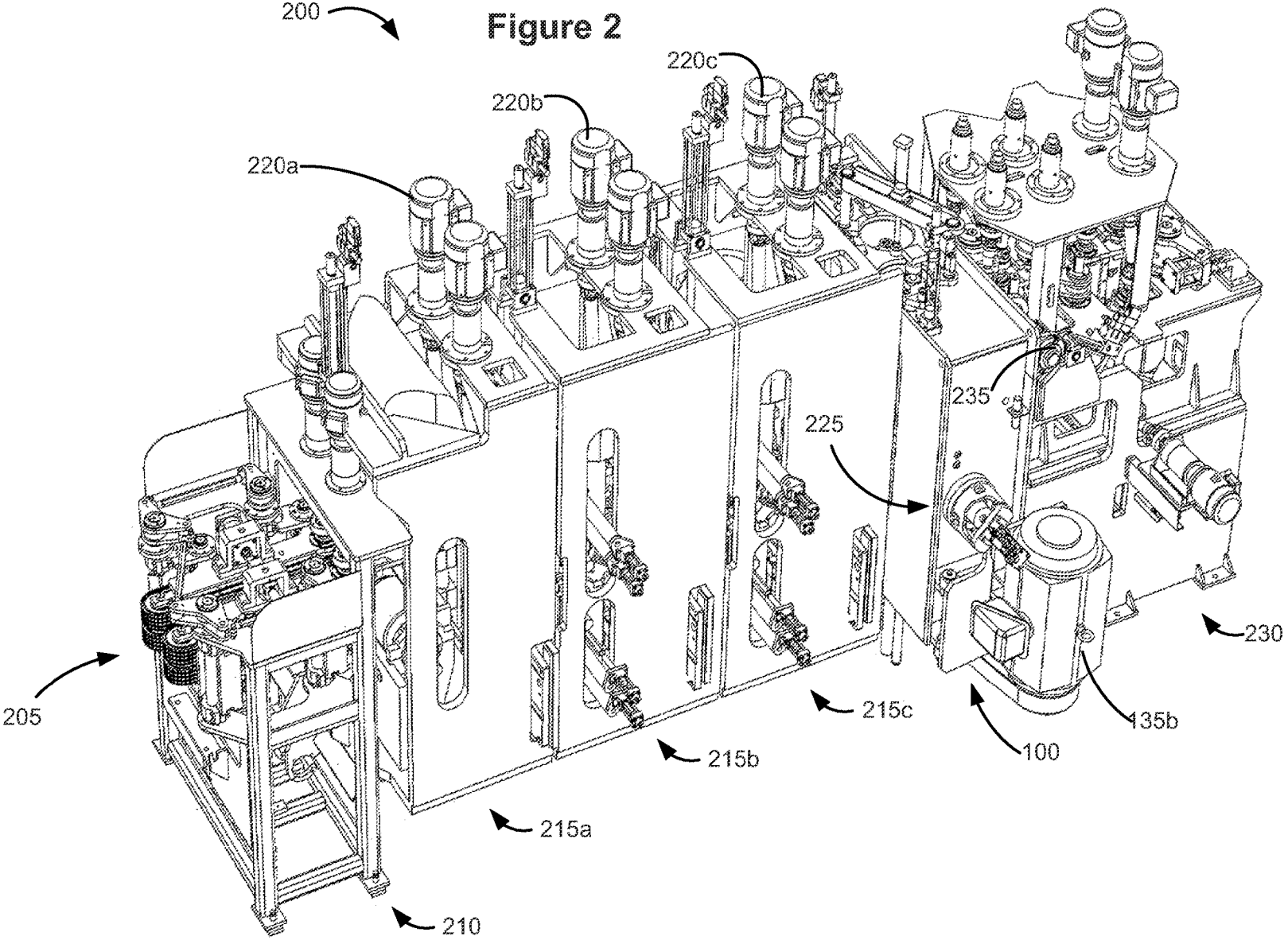
FIG. 2 depicts a perspective view of a log sawing apparatus, according to embodiments.

FIG. 2 depicts an embodiment of a sawing system 200 that may use the saw box 100 of FIG. 1. A log may be introduced to an infeed end 205 of the system 200 via an infeed unit 210. The log may be passed through a plurality of chipping units 215*a*, 215*b*, 215*c*. The chipping units 215*a-c* may each contain profiling chip heads. In some embodiments, all three of chipping units 215*a-c* may not be necessary. For example, if the log has a relatively small diameter, then a single chipping unit 215*a* may only be desired. Alternatively, more than three chipping units may be desirable. The chipping units 215*a-c* may each include a plurality of vertical rollers, at least one of which may be attached to a drive 220*a*, 220*b*, 220*c*. The vertical rollers and drives will be described in further detail below.

The log may then pass from the chipping units 215*a-c* to the saw box 100. As described with respect to FIG. 1, the saw box 100 may be coupled with one or more drives, such as drive 135*b*, that are configured to rotate one or more of the arbors within the saw box 100. The saw box 200 may further comprise a pivot assembly 225 coupled with the saw box 100 along the horizontal axis of the saw box 100. As will be described with further detail below, the saw box 100 may be tiltable around the pivot assembly 225, and the saw box 100 may be configured to move laterally along the pivot assembly 225.

After passing through the saw box 100, the leading end of the sawn log may enter an outfeed unit 230. The outfeed unit 230 and the saw box 100 may be coupled to a saw box rotate assembly 235 which is configured to rotate the saw box 100 around the horizontal axis.

Figure 3:
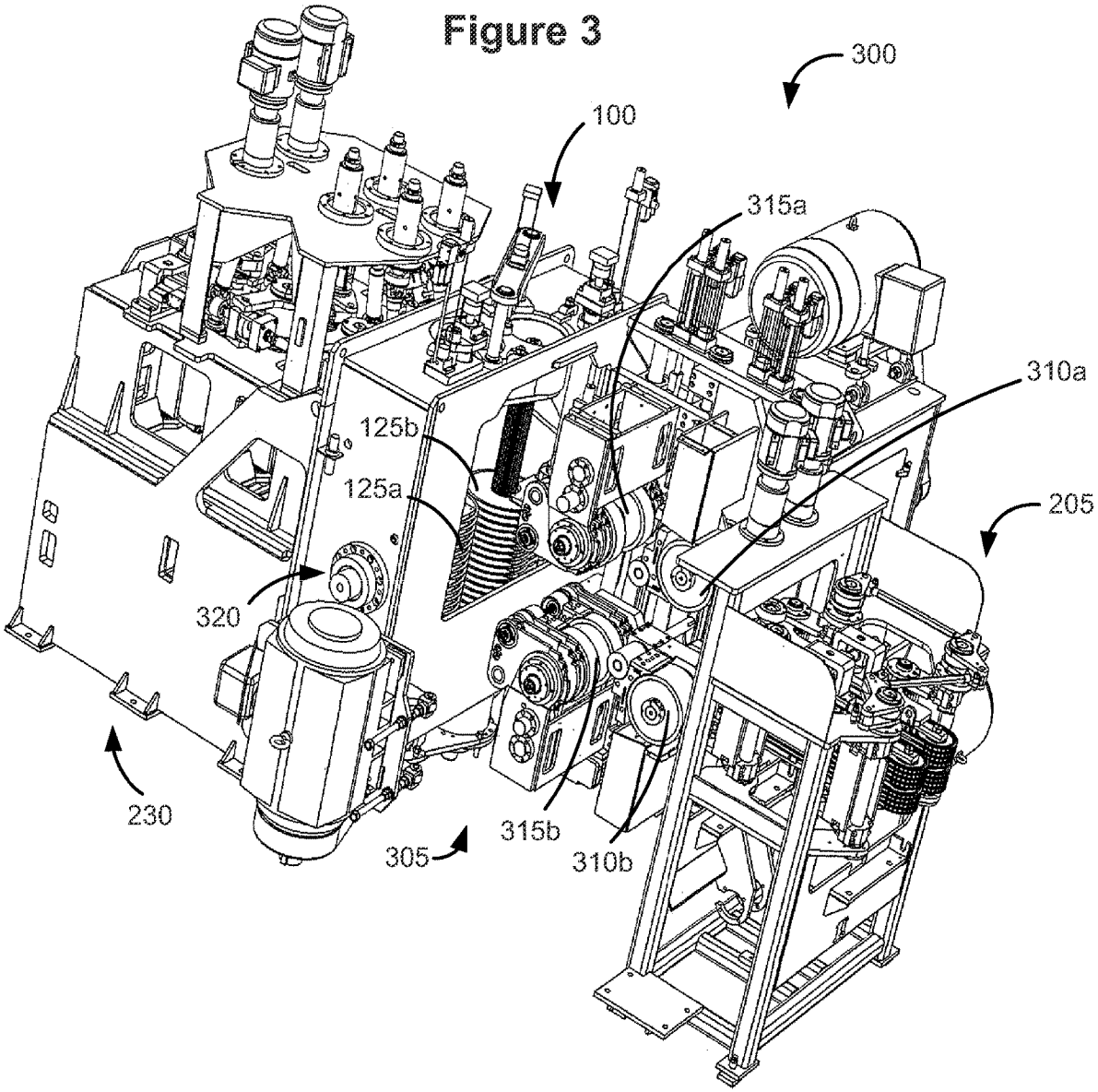
FIG. 3 depicts a perspective view of an alternative log sawing apparatus, according to embodiments.

FIG. 3 depicts an alternative embodiment of a sawing system 300. This system may comprise an infeed unit 205 and a single chipper unit 305. The chipper unit 305 may be identical to one of the chipper units 215*a-c* depicted in FIG. 2, or may have an alternative configuration, for example a configuration combining two or more of chipper units 215*a-c* or groups of chip heads into a single unit. In this embodiment, chipper unit 305 may include a first upper chip head 310*a*, a first lower chip head 310*b*, a second upper chip head 315*a*, and a second lower chip head 315*b*. Any one or more of the chip heads may be profiling chip heads. For example, the first upper and lower chip heads may be configured to produce a flat horizontal surface, and the second upper and lower chip heads may be profiling chip heads.

The log may pass through the chipper unit 305 into the saw box 100. The log then passes from the saw box 100 to an outfeed unit 230. FIG. 3 also depicts an pivot end 320 which may be coupled with the saw box 100 along the horizontal axis of the saw box. This saw box 100 may move laterally along the pivot end 320 responsive to movement of an actuator coupled with pivot assembly 225. Additionally, the saw box 100 may rotate around the pivot end 320 responsive to movement of the saw box rotate assembly 235.

Figure 4:
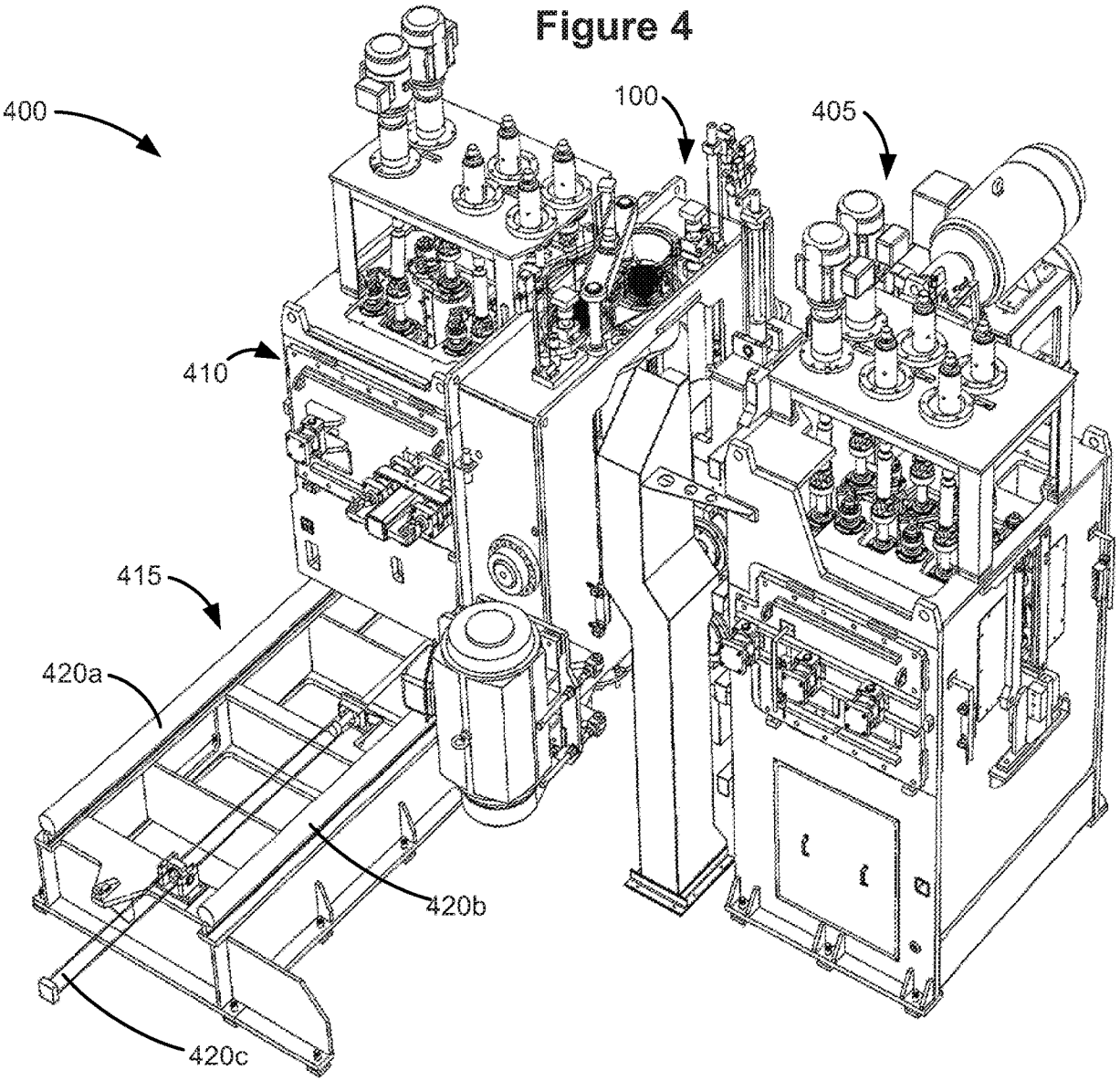
FIG. 4 depicts a perspective view of an alternative log sawing apparatus, according to embodiments.

FIG. 4 depicts another alternative embodiment of a sawing system 400. In this embodiment, the infeed unit and the chipper unit are combined into a single infeed unit 405. A log may be introduced to the infeed unit 405, and then pass from the infeed unit 405 to a saw box 100. From the saw box 100, the log may pass to the outfeed unit 410. In this embodiment, the outfeed unit 410 is laterally moveable along a rail system 415 comprising a plurality of rails 420*a*, 420*b*, 420*c*.

It will be understood that although different infeed units, for example infeed unit 405 and infeed unit 205, or different outfeed units such as outfeed unit 230 or outfeed unit 410 are described with respect to specific systems 200, 300, 400, different embodiments may have different combinations of these units. For example, an alternative system may include outfeed unit 410 coupled with infeed unit 405 and one or more of chipper units 215*a-c*, or chipper unit 305. One skilled in the art will recognize the different combinations possible with the different described units in FIGS. 2-4.

Figure 5:
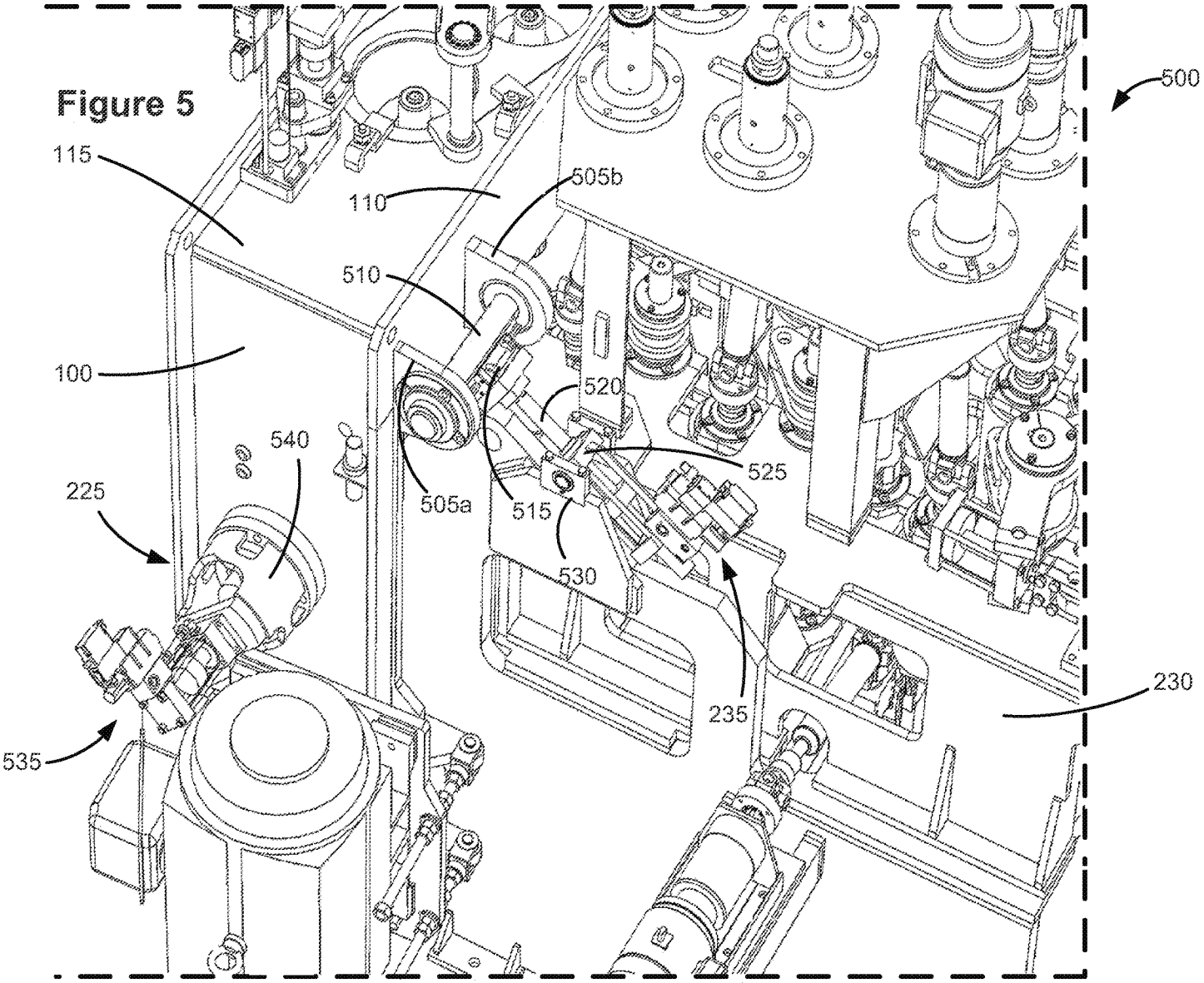
FIG. 5 depicts a close-up perspective view of a log sawing apparatus showing a saw box rotate assembly, according to embodiments.

FIG. 5 depicts a close up perspective view of a portion of a system 500 combining one or more of the outfeed units such as outfeed unit 230, according to embodiments of the disclosure. It will be recognized that the system 500 extends beyond the dashed lines shown in FIG. 5, and that although the discussion with respect to this embodiment includes outfeed unit 230, outfeed unit 410 could alternatively be used.

The system 500 may comprise an outfeed unit 230 and a saw box 100. The saw box 100 may comprise a back side 110 coupled with a plurality of bases 505*a*, 505*b* with a hinge 510 placed therebetween. The hinge 510 may be configured to couple with a carriage 515 of a saw box rotate assembly 235. Saw box rotate assembly 235 may include an actuator (e.g., a linear positioner). The carriage 515 of the saw box rotate assembly 235 may be coupled to the actuator. In the illustrated embodiment, the carriage 515 is coupled to an end of a rod 520 of an actuator which is configured to extend or contract rod 520 with respect to a base 525 of the saw box rotate assembly 235. The saw box rotate assembly 235 may be rotatably coupled with the outfeed unit 230 via one or more hinges 530. The pivot assembly 225 may comprise an actuator 535 coupled with a cylinder mount 540. The cylinder mount 540 may then be coupled with the saw box 100. Further details of the pivot assembly 225 are discussed below with respect to FIG. 7.

As shown in FIG. 5, when the rod 520 extends from the base 525 of the saw box rotate assembly 235, the carriage 515 may exert a force on the hinge 510. This force may cause the saw box 100 to rotate around the horizontal axis of the saw box 100, and the top side 115 of the saw box 100 may move away from the outfeed unit 230. By contrast, when the rod 520 contracts towards the base 525 of the saw box rotate assembly 235, the carriage 515 may exert a force on the hinge 510 that causes the saw box 100 to rotate such that the top side 115 of the saw box 100 moves closer to the outfeed unit 230.

It will be recognized that a different configuration of the hinge 510 and bases 505*a*, 505*b* is possible such that the hinge 510 is connected to the saw box 100 by only a single base, or more than 2 bases. Additionally, the saw box 100 may be connected to a plurality of saw box rotate assemblies configured to rotate the saw box 100.

Figure 6:
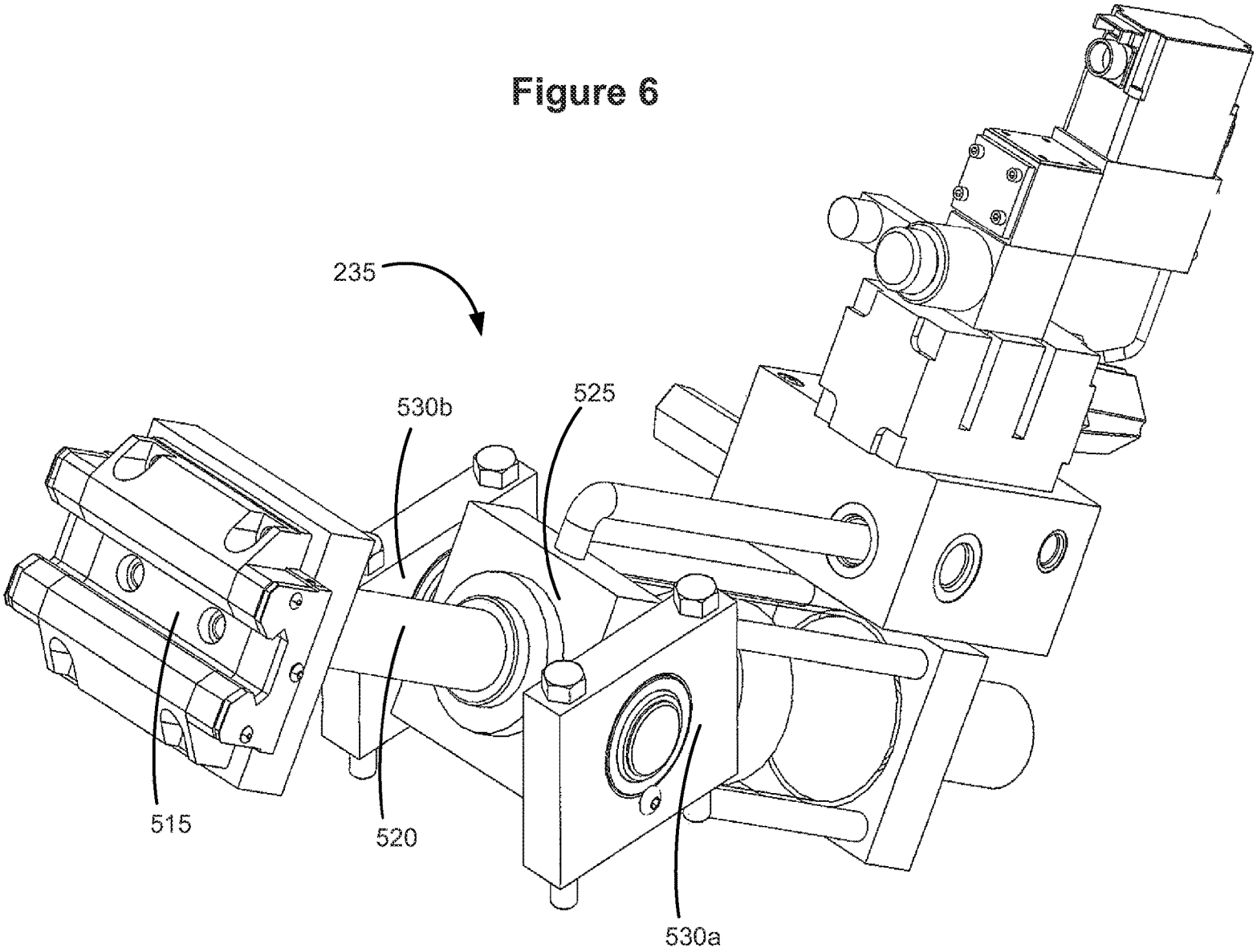
FIG. 6 depicts an alternative perspective view of a saw box rotate assembly, according to embodiments.

FIG. 6 depicts a perspective view of the saw box rotate assembly 235 including the carriage 515, the rod 520, the base 525 and two hinges 530*a*, 530*b* which may be used for coupling the saw box rotate assembly 235 to an outfeed unit 230 according to embodiments. It will be noted that the carriage 515 is configured such that it may slide along the hinge 510 if the saw box 100 moves laterally. In this manner, the saw box 100 may slide laterally and not be decoupled from the saw box rotate assembly 235.

Figure 7:
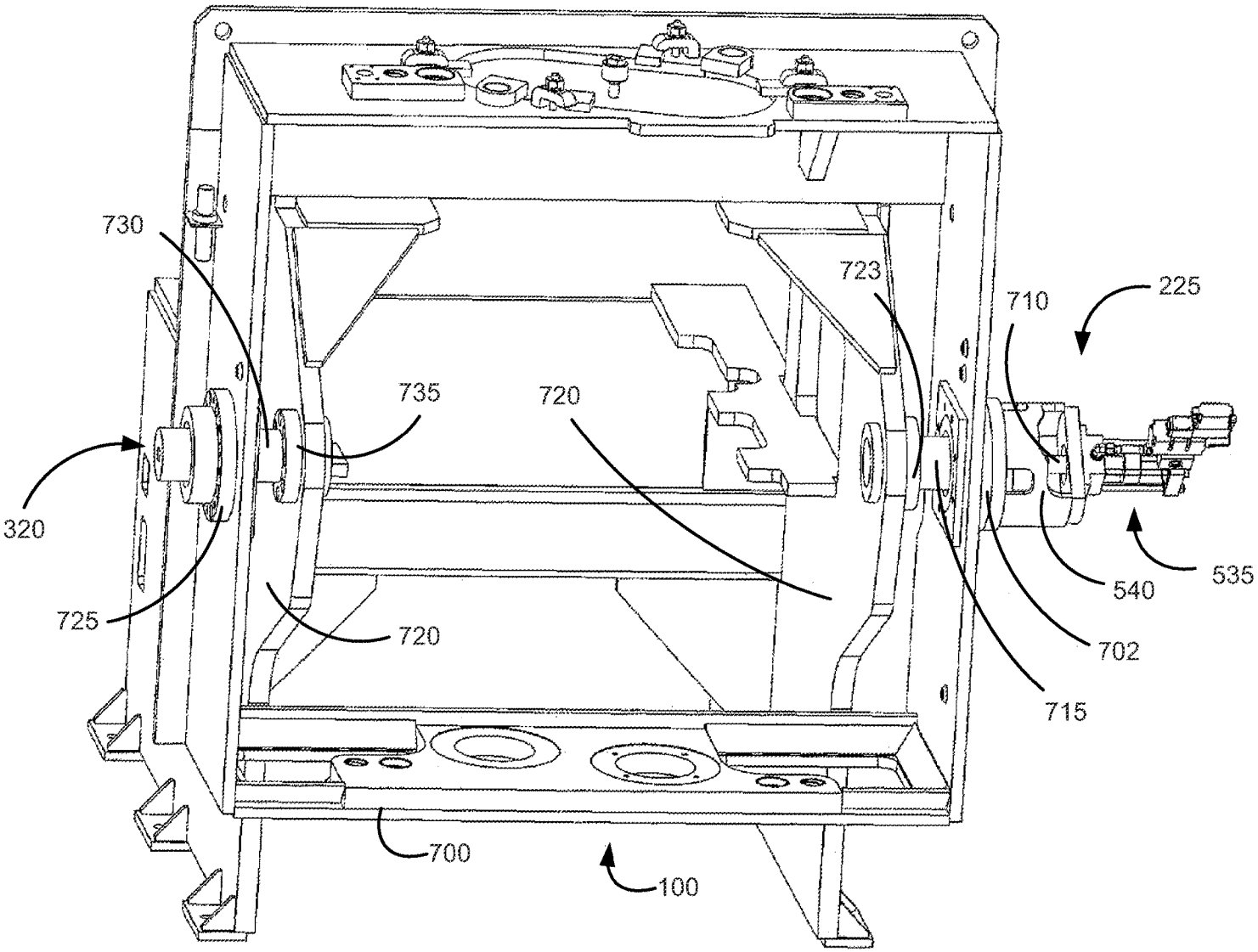
FIG. 7 depicts a cut-away view of a saw box, according to embodiments.

FIG. 7 depicts a view of a saw box 100 showing how lateral and rotational movement of the saw box 100 may be achieved according to embodiments. The saw box 100 may include a frame 700 which may be coupled with a pivot assembly 225. The pivot assembly 225 may include an actuator 535 and a cylinder mount 540. The cylinder mount 540 is shown as partially cut away in FIG. 7. The actuator 535 may be coupled with the cylinder mount 540, which may be coupled with the frame 700 of the saw box 100. In some embodiments, the cylinder mount 540 may be coupled with the frame 700 via a bushing 702. The actuator 535 may further include a rod 710 which extends from the actuator 535 into the cylinder mount 540.

The pivot assembly 225 may further comprise a pivot pin 715 which extends through the frame 700 of the saw box 100 and is coupled with the rod 710 of the actuator 535 inside of the cylinder mount 540. The pivot pin 715 may also be coupled with an internal support such as a portion of the frame 720 of an outfeed unit such as outfeed units 230 or 410 via a second bushing 723.

FIG. 7 further depicts a pivot end 320 which may be coupled with the frame 700 of the saw box 100 on an opposite side of the saw box 100 from the pivot assembly 225. The pivot end 320 may comprise a bushing 725 coupled with the frame 700 of the saw box 100. The bushing 725 may also be coupled with a second pivot pin 730 of the pivot end 320. The second pivot pin 730 may be further coupled with another portion of the frame 720 of an outfeed unit via bushing 735.

In some embodiments, the actuator 535 may create a force on the rod 710 which is coupled with the pivot pin 715. Because the pivot pin 715 may be coupled with the frame 720 of an outfeed unit, the force may cause the saw box 100 to move horizontally with respect to the outfeed unit. For example, if the actuator 535 extends the rod 710, the force of the rod 710 may cause the actuator to move further from the frame 720. Because the actuator may be coupled with, and inseparable from, the frame 700 of the saw box 100, the frame 700 may slide laterally along pivot pins 715 and 730 and move to the right as viewed in FIG. 7. By contrast, if the actuator 535 contracts the rod 710, the frame 700 of the saw box 100 may move to the left as viewed in FIG. 7. Additionally, because of bushings 725, 735, 723, and 702, the saw box 100 may be able to move rotationally with respect to the frame 720 of the outfeed unit, as described above with respect to FIGS. 5 and 6.

It will be recognized that in other embodiments, an actuator may also be coupled with the pivot end 320. Some embodiments may have multiple actuators. Additionally, the actuator may be coupled elsewhere on the frame 700 of the saw box 100, and still operable to create a force on pivot pin 715.

Figure 8:
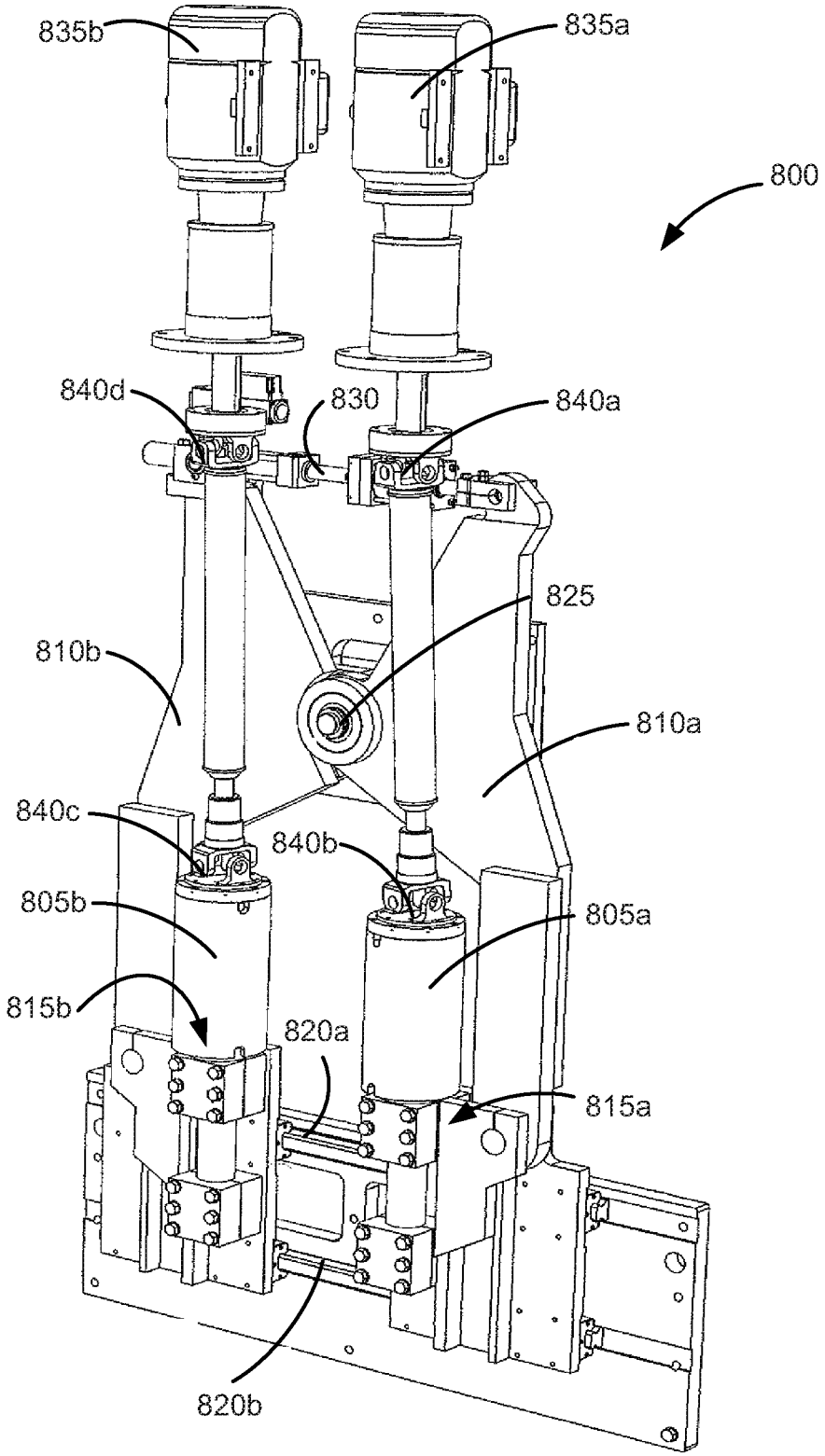
FIG. 8 depicts a vertical roller and drive assembly, according to embodiments.

FIG. 8 depicts an embodiment of a vertical roller and drive assembly 800 that may be present in one or more of chipper units 215*a-c*, as described above with respect to FIG. 2. The assembly 800 comprises a plurality of vertical rollers 805*a*, 805*b*. In this embodiment, there are only two vertical rollers 805*a*, 805*b*, though other embodiments may have more or less rollers. The rollers 805*a*, 805*b* are coupled with a first lever 810*a* and a second lever 815*b*. In one embodiment, the rollers 805*a*, 805*b* may be coupled with respective levers 810*a*, 810*b* via respective carriages 815*a*, 815*b* pivotably attached to respective levers 810*a*, 810*b* and configured to slide laterally along a plurality of guiderails 820*a*, 820*b*. Although two carriages 815*a*, 815*b* and two guiderails 820*a*, 820*b* are shown in the depicted embodiment, it will be appreciated that more or less carriages and/or guiderails may be used. The carriages may be movably coupled to the levers. For example, the carriages may be pivotably coupled to the levers by a pin or shaft.

The levers 810*a*, 810*b* may be coupled with one another via a pivot 825 defining a pivot axis. The levers 810*a*, 810*b* may also be coupled with one another via an actuator 830. In the depicted embodiment, when the actuator 830 expands, the levers 810*a*, 810*b* may pivot around the pivot axis 825. When the levers 810*a*, 810*b* pivot around the pivot axis 825, the carriages 815*a-d* may slide along the guiderails 820*a*, 820*b* and result in rollers 805*a*, 805*b* moving closer to one another. Similarly, when the actuator 830 contracts, the levers 810*a*, 810*b* may pivot around the pivot axis 825 in such a manner that the carriages 815*a-d* move horizontally along the guiderails 820*a*, 820*b* and the rollers move vertically further from one another.

It will be appreciated that in other embodiments, the placement of the actuator 830, the pivot 825 and the rollers 805*a*, 805*b* may be altered with respect to the lever 810*a*, 810*b*. For example, the levers 810*a*, 810*b* may cross one another at the pivot axis 825. Alternatively, the pivot axis 825 may be located at a top portion of the levers 810*a*, 810*b*, and the actuator 830 may be located in a middle portion of the levers 810*a*, 810*b*. Other embodiments may have different mechanical structures, as will be recognized by one of ordinary skill in the art. It will also be recognized that the actuator 830 may be hydraulic, electric, mechanical, or some other form of actuator as will be recognized in the art.

The rollers 805*a*, 805*b* may be passive, or they may be powered. If they are powered, they may be coupled with one or more drives 835*a*, 835*b* via one or more universal joints 840*a-d*. In the depicted embodiment, roller 805*a* is coupled with drive 835*a* by a shaft member with two universal joints 840*a*, 840*b*. Additionally, roller 805*b* is coupled with drive 835*b* via another shaft member with universal joints 840*c*, 840*d*. In other embodiments, other types of movable joints known in the art may be used instead of universal joints. The universal joints 840*a-d* may be desirable because they may allow the rollers 805*a*, 805*b* to move with the carriages along the guiderails 820*a*, 820*b* without becoming decoupled from drives 835*a*, 835*b* or altering the vertical orientation of the rollers 805*a*, 805*b*.

One of skill in the art will recognize that the described embodiments offer several advantages. For example, the use of one or more vertical roller and drive assemblies 800 in one or more infeed units 215*a-c* may allow an operator of a sawing system 200 to precisely center and orient a log being sawed, even if the log has a different thickness than the log before it. Additionally, the use of a saw box 100 that is able to move both laterally and rotationally may allow for the precise sawing of logs of different widths or orientations without having to spend large amounts of down time on re-positioning the elements of the sawing apparatus 200. In addition, the ability to move the saw box 100 laterally means that if the saws need to be moved laterally, the saw box 100 can move to accommodate the log rather than having to move an infeed of a sawing system. These benefits will offer savings in terms of time and operator effort.

Although certain embodiments have been illustrated and described herein for purposes of description, this application is intended to cover any adaptations or variations of the embodiments discussed herein. Therefore, it is manifestly intended that embodiments described herein be limited only by the claims.

Where the disclosure recites "a" or "a first" element or the equivalent thereof, such disclosure includes one or more such elements, neither requiring nor excluding two or more such elements. Further, ordinal indicators (e.g., first, second or third) for identified elements are used to distinguish between the elements, and do not indicate or imply a required or limited number of such elements, nor do they indicate a particular position or order of such elements unless otherwise specifically stated.

What is claimed is:

1. A system for cutting wood, comprising:

a support with a first portion and a second portion;

a first pivot member coupled to the first portion;

a second pivot member coupled to the second portion, wherein the pivot members are aligned along a first axis that passes through the pivot members and said portions of the support;

a saw box with a top, a bottom, and opposite first and second sides, wherein each of the sides has a respective opening and a respective bushing coupled to the opening, the first pivot member extends at least partially through the bushing of the first side and the second pivot member extends at least partially through the bushing of the second side, such that the saw box is pivotable about the first axis and laterally movable along the first axis relative to the support, wherein the saw box is configured to retain one or more saw arbors between the sides in an orientation that is generally parallel to the sides.

2. The system of claim 1, wherein the support is part of an outfeed, and the first and second portions of the support are portions of an upstream end of the outfeed.

3. The system of claim 1, further comprising an infeed disposed upstream of the saw box, wherein the infeed includes a first pair of positioning rolls that are rotatable around corresponding vertical axes of rotation, the infeed further comprising a pivot member defining a pivot axis, a first lever coupled to a first one of said positioning rolls, and a second lever coupled to a second one of said positioning rolls, the first and second levers connected by the pivot member, wherein the first and second levers are pivotable around the pivot axis to thereby laterally displace the positioning rolls.

4. The system of claim 3, the infeed further comprising a lateral support member, a first carriage member pivotably coupled to the first lever, and a second carriage member pivotably coupled to the second lever, the first and second carriage members slideably coupled to the lateral support member, wherein the first one of the positioning rolls is mounted to the first carriage member and the second one of the positioning rolls is mounted to the second carriage member.

5. The system of claim 4, the infeed further comprising a second actuator coupled to the first lever, the second actuator operable to pivot the first lever around the pivot axis to thereby move the first carriage member along the lateral support member.

6. The system of claim 4, further comprising a first drive coupled to the first one of the positioning rolls by a first shaft with one or more universal joints, wherein the first drive is operable to rotate the first one of the positioning rolls while the first carriage member is moved along the lateral support member.

7. The system of claim 1 wherein the one or more saw arbors is two saw arbors that are offset from one another along the first axis and along a feed axis that extends between the sides of the frame and between the sides of the saw box.

8. The system of claim 1, wherein the support is a frame of an outfeed unit, the system further comprising a pivot assembly coupled with the saw box and the outfeed unit, the pivot assembly comprising:

a linear actuator with a first end and a second end, the first end coupled with the outfeed unit;

a carriage coupled with the second end of the linear actuator; and a hinge member coupled to the saw box and the carriage, wherein the linear actuator is selectively actuable to tilt the saw box about the first axis, and the carriage assembly is configured to moveably engage the hinge member to thereby allow the saw box to move laterally along the first axis while tilting about the first axis.

9. The system of claim 8 wherein the hinge member is disposed above the first axis on an output end of the saw box.

10. The system of claim 1, further comprising an infeed unit with at least one pair of profiling heads disposed upstream of the saw box.

11. The system of claim 10, wherein the infeed unit further comprises an upper chip head and a lower chip head disposed upstream of the profiling heads, wherein the upper chip head and the lower chip head are configured to chip flat faces along the upper and lower surfaces, respectively, of the log.

12. A method of sawing boards from a curved log, the method comprising:

orienting the log such that the curved faces of the log substantially overlie one another along a flow direction;

conveying the log through a saw box with a plurality of saws arrayed on one or more saw arbors disposed between, and oriented generally parallel with, opposite first and second sides of the saw box, wherein the saw box is movably coupled to a support by a pair of pivot members, and each of the pivot members is coupled to a respective portion of the support and extends through a respective one of the sides of the saw box, and wherein the pivot members are aligned along a first axis that extends through the saw box and the portions of the support; and while conveying the log through the saw box, tilting the saw box about the first axis and moving the saw box laterally along the first axis to thereby cause the saws to follow the curvature of the log.

13. The method of claim 12, further comprising conveying the log through an infeed unit upstream of the saw box.

14. The method of claim 13, wherein the infeed unit includes an upper chip head and a lower chip head, and wherein conveying the log through the infeed unit includes chipping flat faces along the upper and lower surfaces of the log with the upper and lower chip heads, respectively.

15. The method of claim 14, wherein the infeed unit includes profiling chip heads downstream of the upper and lower chip heads, and wherein conveying the log through the infeed unit further includes profiling the log with the profiling chip heads.

16. The method of claim 13, wherein the infeed unit includes profiling chip heads, and wherein conveying the log through the infeed unit further includes profiling the log with the profiling chip heads.

17. The method of claim 12, wherein the support is part of a frame of an outfeed, and tilting the saw box about the first axis includes using a first linear actuator to apply force against a first portion of the saw box, and wherein moving the saw box laterally along the first axis includes using a second linear actuator to apply force against the saw box in a second direction that is transverse to the first direction.

18. The method of claim 17, wherein the first portion of the saw box is located along an output end of the saw box and above the first axis.

* * * * *